United States Patent [19]

Cleveland et al.

[11] 4,273,081

[45] Jun. 16, 1981

[54] VENT VALVE FOR ENGINE COOLING SYSTEMS

[75] Inventors: Gary L. Cleveland, Washington; Clyde O. Taylor, Peoria, both of Ill.

[73] Assignee: Caterpillar Tractor Co., Peoria, Ill.

[21] Appl. No.: 57,480

[22] Filed: Aug. 27, 1979

[51] Int. Cl.[3] ..... F01P 7/14

[52] U.S. Cl. ..... 123/41.08; 123/41.05; 137/211

[58] Field of Search ..... 123/41.05, 41.08, 41.54; 137/202, 211

[56] References Cited

U.S. PATENT DOCUMENTS

| | | | |
|---|---|---|---|
| 833,093 | 10/1906 | Stevenson | 137/202 |
| 2,172,097 | 9/1939 | Burks | 137/211 |
| 3,132,634 | 5/1964 | Butler | 123/41.54 |
| 3,820,593 | 6/1974 | Pabst | 123/41.54 |
| 4,052,965 | 10/1977 | Morris | 123/41.08 |

FOREIGN PATENT DOCUMENTS

| | | | |
|---|---|---|---|
| 460038 | 10/1949 | Canada | 137/211 |
| 146711 | 12/1955 | Fed. Rep. of Germany | 137/41.54 |

*Primary Examiner*—Ronald H. Lazarus

*Attorney, Agent, or Firm*—Phillips, Moore, Weissenberger, Lempio & Majestic

[57] ABSTRACT

A check valve (32) comprises a housing (33) having an inlet (34) and an outlet (40) defined therein and first (43) and second (45) ramp surfaces are defined in the housing (33) at varying acute angles (a,b) relative to a longitudinal axis (X) of the valve (32). A valve element (41) is mounted in the housing (33) for sequential movement along the ramp surfaces (43,45) to close the outlet (40) in response to fluid flow through the valve (32). The check valve (32) finds particular application for use as a vent valve in a cooling system (11) for an internal combustion engine to avoid the overcooling problem which is prevalent with conventional cooling systems wherein a continuously open port is employed in association with a thermostat for air-purging purposes.

14 Claims, 4 Drawing Figures

VENT VALVE FOR ENGINE COOLING SYSTEMS

DESCRIPTION

TECHNICAL FIELD

This invention relates to a vent valve in a cooling system for an engine which allows the venting of air therethrough upon filling of the engine with liquid coolant and thereafter closes upon running of the engine.

BACKGROUND ART

A cooling system for an internal combustion engine includes a thermostat which controls coolant flow from the engine proper to an air-cooled radiator. In addition, a vent hole is normally formed through an internal wall of the engine, mounting the thermostat thereon, to vent air to the radiator upon filling of the engine with coolant. In applications, such as school buses, wherein pick-up and delivery services require running of the bus at low idle approximately 60–70% of the time, the engine will tend to over-cool when ambient temperatures are in the range of 20° F. and below. Such over-cooling of the engine will prevent the bus's heater from discharging sufficient heat to maintain the interior of the bus at an acceptably high temperature level, such as 65° F.

One solution to this over-cooling problem is to substitute a vent valve in lieu of the continuously open vent hole which includes a movable valve element which will close an outlet from the vent valve after filling of the engine with coolant and venting of air therefrom. A vent valve of this type is disclosed in U.S. Pat. No. 4,052,965, issued on Oct. 11, 1977, to Charles S. Morris, and assigned to the assignee of this application. The vent valve is vertically disposed and the valve element thereof constitutes a spherical ball member which is adapted to move vertically upwardly to engage a valve set to close an outlet from the vent valve upon filling of the engine with coolant.

Any attempt to mount the vent valve horizontally in the engine could give rise to operational problems since inner surfaces of the housing of the vent valve, which intersect the frusto-conically shaped valve seat, would be disposed horizontally. Thus, premature closing of the vent valve could ensue. Furthermore, the abrupt angle change between such horizontally disposed inner surfaces and the valve seat could render it difficult for the ball member to expeditiously and efficiently close the outlet from the vent valve. In addition, the ball member may tend to remain in the area of the valve seat to thus prevent full opening thereof when the engine and the cooling system therefor are operational to purge the engine of air through the outlet from the vent valve.

DISCLOSURE OF THE INVENTION

The present invention is directed to overcoming one or more of the problems as set forth above.

In one aspect of this invention, a check valve employed in a cooling system for an engine comprises a housing having a chamber defined therein between an inlet and outlet thereof, a first ramp defined in the housing to terminate at the outlet to define a first acute angle relative to a longitudinal axis of the check valve, a second ramp also defined in the housing to intersect the first ramp and disposed at a second acute angle relative to the longitudinal axis of the vent valve which is substantially less than the first acute angle, and valve element means for sequentially moving along the first and second ramps to close the outlet of the vent valve in response to flow of fluid from the inlet to the outlet. The valve element means comprises a spherical ball and the inlet includes a port, formed through a lower side of the housing, which has a diameter less than the ball's diameter to permit the ball to seat thereon when the check valve is in its open condition of operation.

In another aspect of this invention, the check valve is employed as a vent valve in a cooling system for an engine wherein a first chamber is defined in the engine and a second chamber is defined in the cooling system. The vent valve cooperates with a thermostat which normally prevents liquid coolant from communicating from the first chamber to the second chamber and opens to effect such communication when the temperature of the coolant in the first chamber rises above a predetermined level. The vent valve is horizontally disposed whereby the first and second ramps cooperate to precisely guide movements of the valve element means to initially purge air from the first or engine chamber therethrough and thereafter closes upon engine start-up and when the first chamber is at least substantially filled with liquid coolant. The length of the second ramp and the volume of the third chamber are substantially greater than the size of the valve element.

The valve of this invention thus functions efficiently to closely control the movements of the valve element means between its open and closed positions and is particularly adapted for use in a cooling system for an engine wherein the temperature level of the coolant circulated through the engine and through the heater associated therewith must be maintained at an acceptable maximum level for heating purposes.

BRIEF DESCRIPTION OF THE DRAWINGS

Other objects and advantages of this invention will become apparent from the following description and accompanying drawings wherein.

BEST MODE FOR CARRYING OUT THE INVENTION

Figure 1:
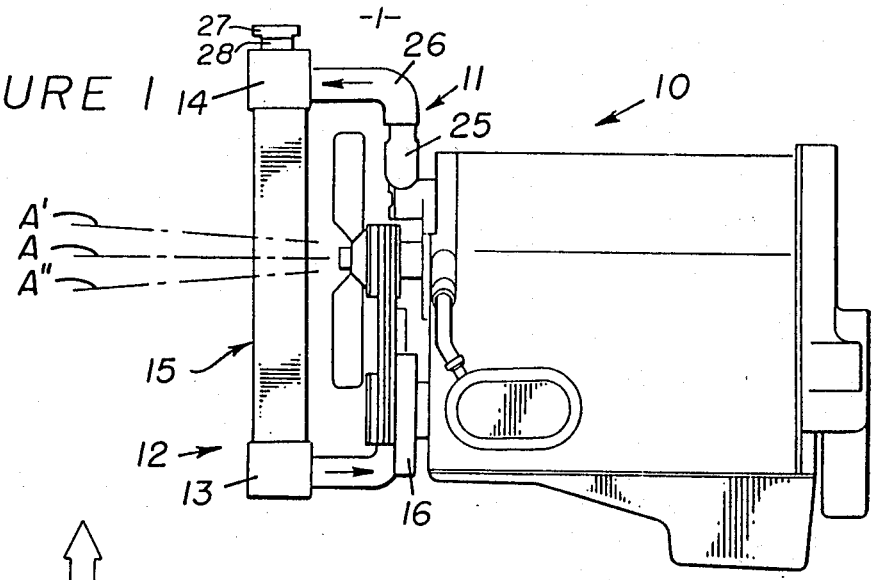
FIG. 1 is a side elevational view of an engine having a cooling system associated therewith, the cooling system including a vent valve embodiment of the present invention therein.

FIG. 1 illustrates an internal combustion engine 10 having a cooling system 11 associated therewith. The cooling system comprises a standard radiator 12 having a lower tank 13, an upper tank 14, and an air-cooled core 15 suitably connected therebetween. Cooling system 11 functions in a conventional manner to circulate a standard liquid coolant through engine 10 and core 15 by means of an engine-driven pump 16.

Figure 3:
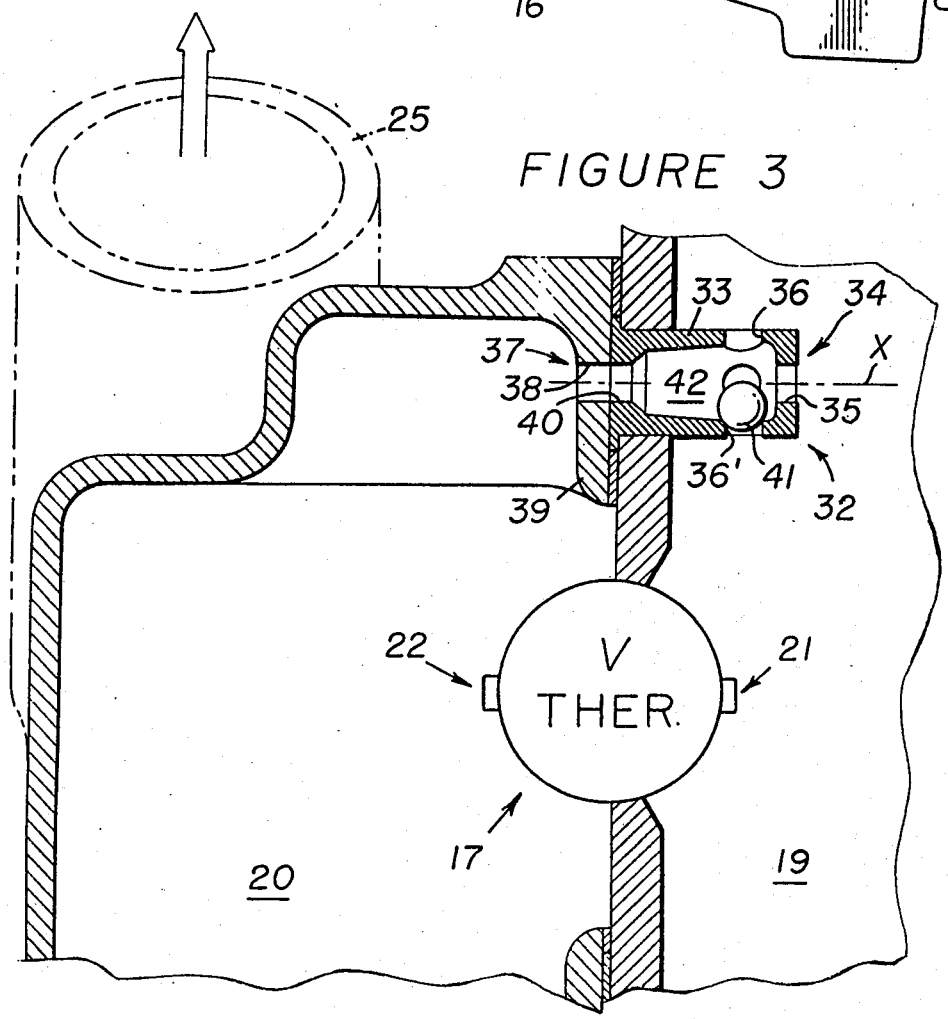
FIG. 3 is an enlarged sectional view illustrating the vent valve and a thermostat associated therewith, the view being taken in the direction of arrows III—III in FIG. 2.

Referring to FIG. 3, cooling system 11 further comprises a standard thermostat 17, mounted on a wall 18 of engine 10, which normally prevents communication of engine coolant from an engine or first chamber 19 to a second chamber 20 of cooling system 11 and will open to communicate the chambers when the temperature of the coolant from chamber 19 rises above a predetermined level. When thermostat 17 is in its open position, coolant will flow from an inlet side 21 to an outlet side 22 of thermostat 17.

In cooling systems of this type it has been common practice to provide a continuously open orifice (not shown) in thermostat 17 and to further provide a continuously open vent hole (not shown), formed through wall 18, adjacent to thermostat 17, to continuously communicate chambers 19 and 20. This arrangement primarily functions to vent air to upper tank 14 of radiator 12 (FIG. 1), via chamber 20, an elbow 25, and a hose 26. A vented cap 27 is removably mounted on a filler tube 28 of radiator 12 to thus vent the air to ambient.

Figure 2:
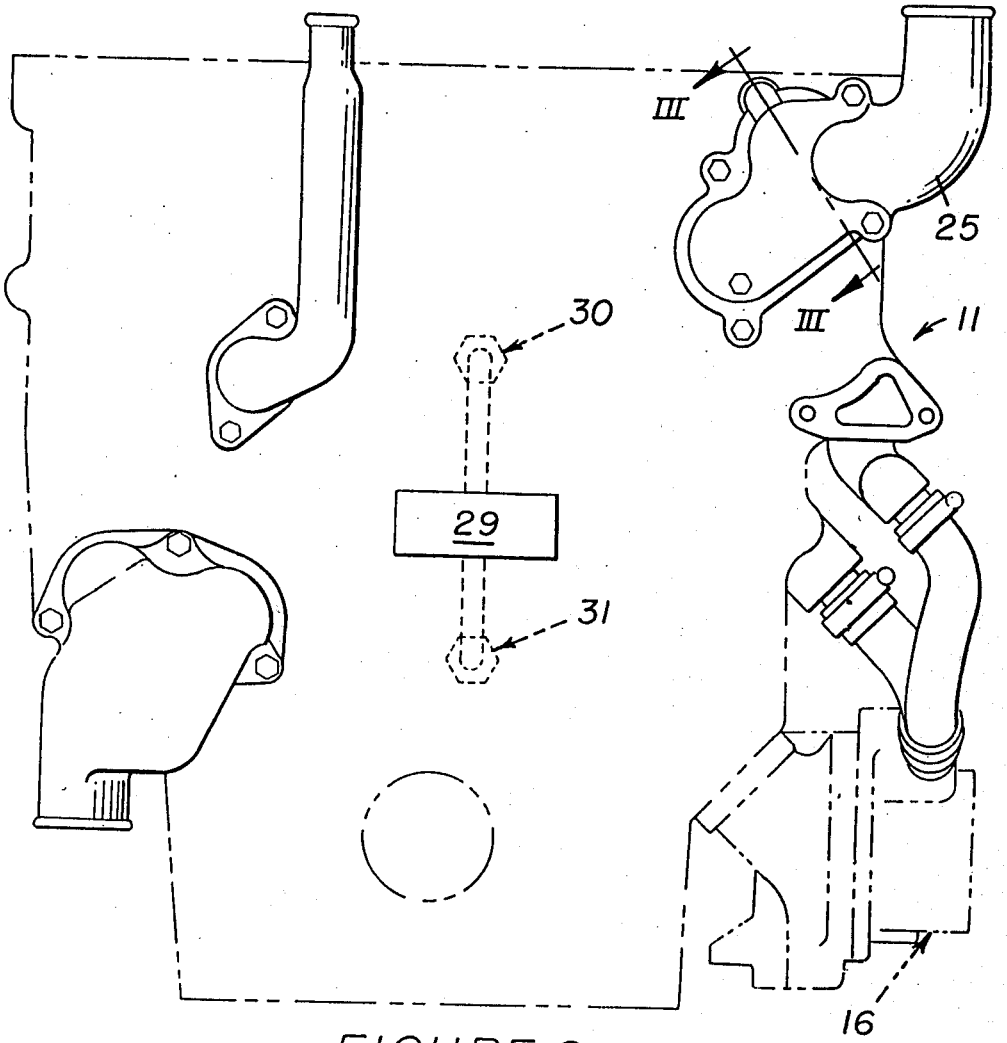
FIG. 2 is an enlarged side elevational view, schematically illustrating the cooling system.

One of the problems encountered with this arrangement is that after the air has been purged from engine chamber 19, upon filling thereof with coolant, a portion of the heated coolant will continuously flow through the vent hole and orifice and will be recirculated through cooling system 11. Thus, when a vehicle of the pick-up or delivery type, such as a school bus, is operating in ambient temperatures of 20° F. and below, the engine will tend to over-cool to thus prevent the coolant circulated to a water heater, schematically illustrated at 29 in FIG. 2, from reaching a predetermined, acceptable level. The heater, of course, is mounted interiorly of the vehicle to maintain the temperature therein at a comfortable level, such as 65° F. As schematically represented in FIG. 2, heater 29 may be suitably interconnected in a conventional manner between outlet and inlet fittings 30 and 31 which are suitably connected to cooling chambers of engine 10, such as chamber 19 shown in FIG. 3.

As further shown in FIG. 3, the above over-cooling problem is solved by the use of a vent or check valve 32 which is suitably secured on wall 18. Vent valve 32 essentially functions to vent air from chamber 19 to chamber 20 upon filling of chamber 19 with liquid coolant and to close after chamber 19 has been at least substantially filled to prevent communication of coolant therethrough. Thermostat 17 will, of course, remain operational to communicate coolant from chamber 19 to chamber 20 to prevent overheating of engine 10 in a conventional manner. Thermostat 17 does not employ the standard type of continuously open orifice therein and, thus, all of the air purging from chamber 19 is solely effected by vent valve 32. The mounting of valve 32 adjacent to the top of chamber 19 ensures purging of substantially all of the trapped air therefrom.

Figure 4:
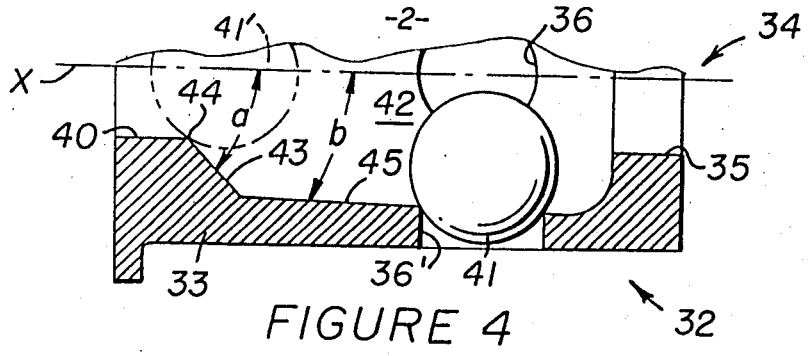
FIG. 4 is an enlarged sectional view, partially illustrating the vent valve.

Referring to FIGS. 3 and 4, vent valve 32 comprises a housing 33 having an inlet 34 which includes a first port 35, disposed on a longitudinal axis "X" of vent valve 32, and a plurality (four illustrated) of radially disposed, second ports 36. An outlet 37 from vent valve 32 which communicates with chamber 20 comprises a hole 38 formed through a flange member 39, and a port 40 formed in housing 33 and which is longitudinally aligned with respect to port 35. A valve element 41, preferably a spherical ball composed of stainless steel, is disposed within a chamber 42 defined in housing 33 and has a diameter slightly greater than the diameters of ports 35, 36 and 40.

When vent valve 32 is in its open position shown in FIGS. 3 and 4, valve element 41 will partially seat on a lower port 36' of ports 36 to maintain it at a substantial distance from outlet port 40 to provide an unobstructed airflow path from inlet 34 to outlet 37. As more clearly shown in FIG. 4, a frusto-conically shaped first ramp surface 43 is defined internally in housing 33 and terminates at one end thereof at outlet port 40. Ramp surface 43 is defined by a first acute angle "a" which is preferably selected from the range of from 45° to 60°. When valve element 41 moves from its solid-line, open position to its closed position 41' in FIG. 4, it will engage an annular seat 44 in line contact therewith to prevent coolant flow through vent valve 32. A second ramp 45 intersects port 36' and ramp surface 43 and is disposed at a second acute angle "b", relative to axis X, which is substantially less than first acute angle "a." Angle "b" is preferably selected from the approximate range of from 3° to 5°.

Ramp surfaces 43 and 45 cooperate with each other to precisely guide rolling movements of valve element 41 between its open and closed positions, illustrated in FIG. 4. In addition, ramp surface 43 will ensure that valve element 41 will not jam on seat 44 upon opening of vent valve 32, i.e., the center of gravity of valve member 41 is disposed substantially rightwardly of seat 44 and will permit the valve member to fall downwardly onto ramp surface 43 when coolant pressure is relieved in chamber 42. Furthermore, ramp surface 45 will permit valve element 41 to roll rightwardly to its retained, open position on port 36' to provide an unobstructed flow passage through housing 33 of vent valve 32. It should be further noted that the simplicity of vent valve 32 facilitates the adaptation thereof in kit form to an engine cooling system wherein a continuously open vent hole had been used previously.

INDUSTRIAL APPLICABILITY

Vent valve 32 finds particular application to the type of cooling system 11 described above wherein it is desired to purge an engine of air prior to closing of the vent valve to prevent over-cooling thereof. However, it will be understood by those skilled in the arts relating hereto that valve 32, per se, could be used in any check valve applications wherein a fluid in liquid form is used to pressurize the valve to close it when the pressure on the downstream side of the valve exceeds a predetermined level.

Assuming start-up of engine 10, thermostat 17 will remain closed to prevent communication of liquid coolant from engine chamber 19 to chamber 20 in a conventional manner. Simultaneously therewith, vent valve 32 will remain in its open position, illustrated in FIG. 3, to permit venting of air from chamber 19 to chamber 20, via inlet 34, chamber 42 and outlet 37. The purged air will ingress into elbow 25 for communication to vented cap 27 of radiator 12, via hose 26 and fill neck 28 (FIG. 1).

When the liquid coolant in chamber 19 rises to at least substantially fill the chamber, the flow thereof will unseat valve element or ball 41 from port 36 and the ball will roll towards outlet 37 on ramp surface 45. Ball 41 will then roll-up ramp surface 43 and engage seat 44 in line contact therewith to prevent further communication of coolant from chamber 19 to chamber 20 through check valve 32. Closing of check valve 32 will permit the coolant in engine 10, including chamber 19, to rise to an acceptable level whereby sufficient heat will be generated at water heater 29 to maintain the interior of a vehicle at a comfortably warm level. Overheating is, of course, prevented by the periodic opening of thermostat 17 which is thermally sensitive to changes of coolant temperature in chamber 19.

Although valve element 41 is preferably composed of a stainless steel material having a specific gravity approximating 7.85, it should be understood that other materials such as aluminum could be used therefor with the specific gravity of such materials preferably being within the range of from 4.5 to 11.0. Furthermore, as shown in FIG. 1, a longitudinal axis "A" of engine 10 may be horizontally disposed on a vehicle frame or, alternatively, may be orientated to have its front up or down within a range of ±10° as shown by inclined positions A′ and A″ of axis A. In any case, longitudinal axis X of vent valve 32 (FIG. 3) is disposed in at least approximate parallel relationship relative to longitudinal axis A of engine 10.

Other aspects, objects, and advantages of this invention can be obtained from a study of the drawings, the disclosure and the appended claims.

We claim:

1. In a cooling system (11) for an engine (10) disposed on a longitudinal axis (A) thereof and comprising a first chamber (19) defined in said engine (10), a second chamber (20) defined in said cooling system (11), thermostat means (17) for normally preventing coolant from communicating from said first chamber (19) to said second chamber (20) and for opening to communicate coolant from said first chamber (19) to said second chamber (20) in response to the temperature of coolant in said first chamber (19) rising above a predetermined level, and a vent valve (32) including a housing (33) having an inlet (34) and an outlet (37), a third chamber (42) defined in said housing (33), a first ramp surface (43) defined internally on said housing (33) and terminating at an annular seat (44) at said outlet (37) to define a first acute angle (a) relative to a longitudinal axis (X) of said vent valve (32), and a valve element (41) disposed in said third chamber (42), the improvement comprising the longitudinal axis (X) of said vent valve (32) being disposed at least substantially parallel relative to the longitudinal axis (A) of said engine (10) and a second ramp surface (45) defined internally on said housing (33) to intersect said first ramp surface (43) and disposed at a second acute angle (b) relative to the longitudinal axis (X) of said vent valve (32), said second acute angle (b) being substantially less than said first acute angle (a), the length of said second ramp surface (45) in the direction of the longitudinal axis (X) of said vent valve (32) and the volume of said third chamber (42) each being substantially greater than the size of said valve element (41), said valve element movable from a first position substantially remote from said seat to permit unobstructed flow of air from said inlet (34), through said third chamber (42), and to said outlet, to a second position engaging said seat by moving sequentially along said second (45) and first (43) ramp surfaces in response to liquid coolant at least substantially filling said first (19) and third (42) chambers.

2. The cooling system of claim 1 wherein said first acute angle (a) is selected from the approximate range of from 45° to 60° and said second acute angle (b) is selected from the approximate range of from 3° to 5°.

3. The cooling system of claim 1 wherein each of said first (43) and said second (45) ramp surfaces is frustoconically shaped.

4. The cooling system of claim 1 wherein said valve element (41) is a spherical ball (41).

5. The cooling system of claim 4 wherein said ball (41) has a specific gravity in the range of from 4.5 to 11.0.

6. The cooling system of claim 5 wherein said ball (41) is composed of steel and has a specific gravity of about 7.85.

7. The cooling system of claim 4 wherein said inlet (34) includes a port (36′) formed through a lower side of said housing (33), said port (36′) having a diameter less than the diameter of said ball (41) and wherein said ball (41) normally seats on said port (36′) when said vent valve (32) is in its open condition of operation.

8. The cooling system of claim 7 wherein said inlet (34) further includes a longitudinally disposed port (35) formed through an end of said housing (33) and a plurality of radial ports (36), including said first-mentioned port (36′), formed through said housing (33).

9. In a cooling system for an engine, a check valve (32) disposed on a longitudinal axis (X) thereof comprising a housing (33) having an inlet (34) and an outlet (40), a chamber (42) defined in said housing (33) between said inlet (34) and said outlet (40), a first ramp surface (43) defined internally on said housing (33) and terminating at said outlet (40) to define a first acute angle (a) relative to said longitudinal axis (X), a second ramp surface (45) defined internally on said housing (33) to intersect said first ramp surface (43) and disposed at a second acute angle (b) relative to said axis (X) which is substantially less than said first acute angle (a), valve element means comprising a spherical ball (41) for sequentially moving along said second (45) and first (43) ramp surfaces to close said outlet (40) in response to flow of fluid from said inlet (34) to said outlet (40), and said inlet (34) including a port (36′) formed through a lower side of said housing (33), said port (36′) having a diameter less than the diameter of said ball (41) and wherein said ball (41) normally seats on said port (36′) when said check valve (32) is in its open condition of operation.

10. The check valve of claim 9 wherein said first acute angle (a) is selected from the approximate range of from 45° to 60° and said second acute angle (b) is selected from the approximate range of from 3° to 5°.

11. The check valve of claim 9 wherein each of said first (43) and said second (45) ramp surfaces is frustoconically shaped.

12. The check valve of claim 9 wherein said ball (41) has a specific gravity in the range of from 4.5 to 11.0.

13. The check valve of claim 12 wherein said ball (41) is composed of steel and has a specific gravity of about 7.85.

14. The check valve of claim 9 wherein said inlet (34) further includes a port (35) disposed in longitudinal alignment relative to said outlet (40) and formed through an end of said housing (33) and a plurality of radial ports (36), including said first mentioned port (36′), formed through said housing (33).

* * * * *